United States Patent [19]

Blotenberg

[11] Patent Number: 4,781,524

[45] Date of Patent: Nov. 1, 1988

[54] METHOD AND APPARATUS FOR DETECTING PRESSURE SURGES IN A TURBO-COMPRESSOR

[75] Inventor: Wilfried Blotenberg, Dinslaken, Fed. Rep. of Germany

[73] Assignee: Man Gutehoffnungshuette GmbH, Oberhausen, Fed. Rep. of Germany

[21] Appl. No.: 13,659

[22] Filed: Feb. 12, 1987

[51] Int. Cl.[4] ..... F04D 27/02

[52] U.S. Cl. ..... 415/27; 415/1; 415/17

[58] Field of Search ..... 415/1, 17, 26, 27, 28, 415/29

[56] References Cited

U.S. PATENT DOCUMENTS

| | | | |
|---|---|---|---|
| Re. 30,329 | 9/1977 | Rutshtein et al. | 415/1 |
| 3,240,422 | 3/1966 | Pettersen et al. | 415/1 |
| 3,809,490 | 5/1974 | Harner | 415/28 |
| 4,139,328 | 2/1979 | Kuper et al. | 415/27 |
| 4,184,337 | 1/1980 | Bloch | 415/17 |
| 4,274,260 | 6/1981 | Bukajlo | 415/17 |
| 4,384,818 | 5/1983 | Blotenberg | 415/17 |
| 4,627,788 | 12/1986 | Keyes, IV et al. | 415/27 |
| 4,656,589 | 4/1987 | Albers et al. | 415/17 |

FOREIGN PATENT DOCUMENTS

| | | | |
|---|---|---|---|
| 605997 | 5/1978 | U.S.S.R. | 415/17 |
| 641134 | 1/1979 | U.S.S.R. | 415/17 |
| 1163045 | 6/1985 | U.S.S.R. | 415/17 |

*Primary Examiner*—Robert E. Garrett
*Assistant Examiner*—John T. Kwon
*Attorney, Agent, or Firm*—Felfe & Lynch

[57] ABSTRACT

A system (method and apparatus) are disclosed for detecting pressure surges in a turbo-compressor. Either the gas flow rate or gas velocity is measured at the intake or the outlet port of the compressor to produce a signal X. The rate of change of this signal X is determined and represented by a signal Y. The occurrence of surge is sensed and indicated by an output signal Z when the signal Y exceeds a prescribed threshold value.

18 Claims, 2 Drawing Sheets

METHOD AND APPARATUS FOR DETECTING PRESSURE SURGES IN A TURBO-COMPRESSOR

BACKGROUND OF THE INVENTION

The present invention relates to a method and apparatus for detecting pressure surges in a turbo-compressor.

Many methods are known for detecting a compressor surge. The most extensively used method involves monitoring the suction flow (intake volume) of the compressor. Whenever the suction flow falls below a prescribed minimum limit, it is assumed that normal throughflow has broken down and a surge is about to occur.

In this conventional method, the intake flow (volume) is measured by means of either an orifice or a nozzle positioned in the intake duct of the compressor. It is a drawback of this conventional method that the intake throttling device (the orifice or nozzle) causes a permanent pressure loss thereby increasing the total power consumption. Another drawback is that this method is not suitable for fully accurate operation. If an extremely fine or sensitive adjustment is made, the conventional method, under certain circumstances, may indicate surges although no surges have occurred; in the case of too coarse an adjustment, compressor surges might not be detected at all, under certain circumstances.

It has to be considered, when adjusting the system, that the flow at which surge begins varies with the load of the compressor. At low load, surge will start at low flow rates. If the load is increased, surge will start at higher flow rates.

Furthermore, another method is known which monitors the velocity at the compressor intake of the gas to be compressed. In this case, the gas velocity (which is proportional to the square of the flow rate) may be detected simply by comparing the static pressures in two positions of different flow cross-section, already present at the intake duct.

Advantageous with such a method is that the detecting orifice does not cause additional resistance to flow. However, a drawback is that the detecting system for measuring the gas velocity always provides a positive signal even if the flow direction has reversed under the action of a surge. In practice, a differential pressure transducer is employed for this purpose, the negative leg of which is connected to the smallest throttling cross-section of the compressor intake. The positive leg detects the pressure in the vicinity of the compressor intake flange; i.e., in a region of wide flow cross-section.

In this case, compressor surges are detected by monitoring the output signal of the differential pressure transducer for a pressure drop below a given minimum differential pressure. In carrying out this method, the differential pressure transducer may be replaced by a differential pressure switch which produces a signal whenever the differential pressure falls below a given presettable value.

However, this method likewise suffers from the drawback that, with too fine an adjustment, pressure surges are indicated even if no surges have occurred, whereas with too coarse an adjustment, surges cannot be detected at all.

Finally, it should be noted that both the flow rate signal and the velocity signal are superimposed on a "noise" signal due to whirls at the pressure tapping points. This leads to a fluctuating measured signal even at steady flow conditions.

SUMMARY OF THE INVENTION

It is the object of the invention to eliminate the above-mentioned drawbacks and to provide a method for detecting surges, as well as a circuit for carrying out this method, wherein every surge is indicated exactly, while avoiding indication errors.

It is a further object of the present invention to provide a surge detection circuit which lends itself to realization by relatively simple means and which can operate in an interference-free or trouble-free manner even when the noise level in the circuit, in the power supply or in the entire system, becomes high.

In this method, which is advantageously carried out by differentiating the signal X from the differential pressure transducer, the rate of change of the signal X is detected as a signal Y. The value of this signal Y will exceed a prescribed value with the occurrence of surge.

Additionally, this method according to the present invention may be improved by determining the magnitude of change of signal X, in addition to the rate of change of this signal. This change also exceeds a prescribed value when a surge occurs.

In order to be able to operate independently of the noise signals existing in every system, advantageously the rate of change of the signal X for forming the signal Y is determined by inputting the signal X to a summing circuit, both directly and after passing through a delay element.

Alternatively, it is possible that the delay element be designed to provide an output signal $Y_1$ in accordance with an exponential function. The method may also be carried out such that the rate of change of the signal X for forming the signal Y is determined by applying this signal to a summing circuit both directly, on the one hand, and with a delay through added time element, on the other.

As will be seen, the method according to the invention both positively and reliably indicates a compressor surge with a minimum of interference caused by noise signals. As the circuit is uncomplicated and uses only commercially available components, it can be manufactured inexpensively.

For a full understanding of the present invention, reference should now be made to the following detailed description of the preferred embodiments of the invention and to the accompanying drawing.

DESCRIPTION OF THE PREFERRED EMBODIMENTS

Figure 1:
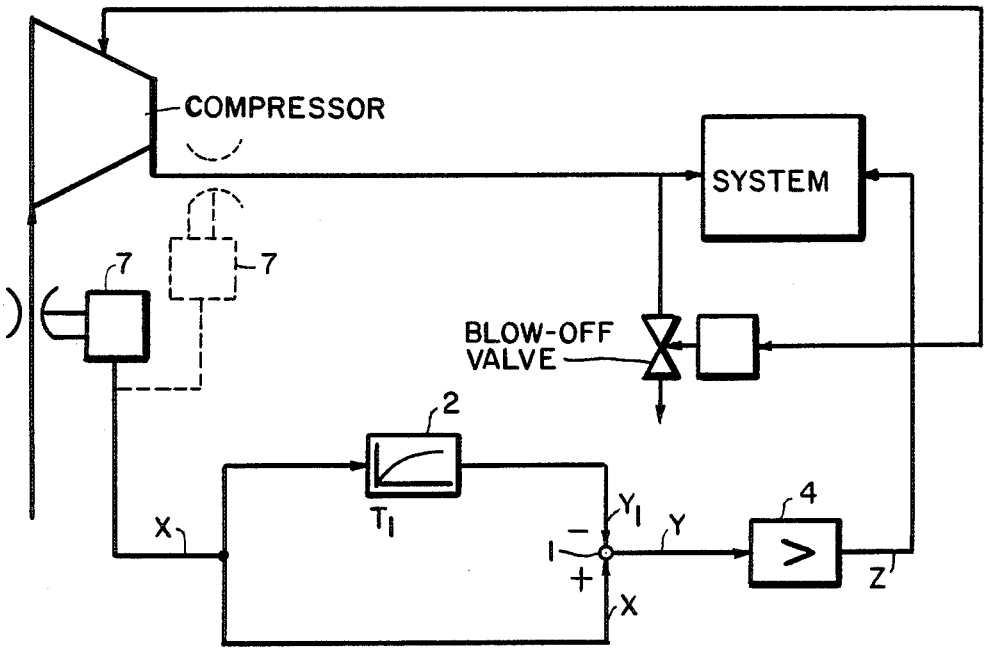
FIG. 1 is a block diagram of a system according to the present invention having a preferred embodiment of a surge protection circuit operating with a delay in accordance with an exponential function.

The preferred embodiments of the present invention will now be described with reference to FIGS. 1 and 2 of the drawing. Identical elements in the two figures are designated with the same reference numerals.

Figure 2:
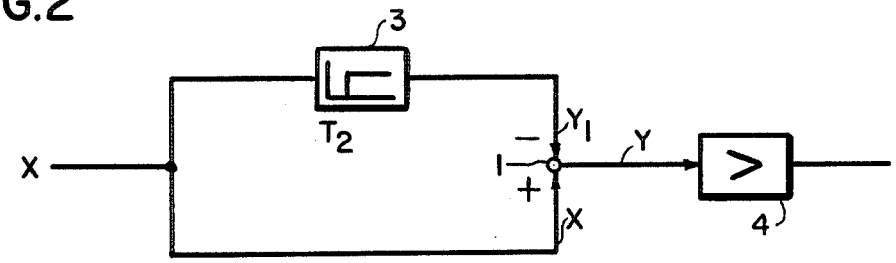
FIG. 2 is a block circuit diagram of another preferred embodiment of a circuit operating with a dead time delay element.

As shown in FIG. 1, the flow rate or flow velocity in either the intake or outlet of a compressor is detected and converted to a signal X in a signal converter 7. Such a conversion is well known in the art and need not be explained in detail here.

The measured value X is supplied to a summing point 1 both directly and with a delay produced by a delay element 2. This summing point 1 derives the difference between these delayed and undelayed values. Expediently, a first order delay element is used as the delay element 2, but other types of delay are also possible.

The term "first order delay element" should be understood to mean that, with a sudden change of the input signal, the output signal rises to this input value with a time delay in accordance with an exponential function. The time constant $T_1$ of this rise is variable. It constitutes an important settable parameter in this embodiment of the system.

The system according to the invention may also operate with delay elements of second order or higher order. It is operable even with the use of a mere "dead time" element 3 according to FIG. 2. The dead time element 3 produces an output identical to, but which lags the input signal by, the delay time $T_2$.

The system according to the invention operates as follows: In the steady state condition, if noise is considered not to present, the measured value X does not change. Accordingly, the values $Y_1$ and X are identical since the output of the delay element has already reached its stationary terminal value. The value $Y=X-Y_1$ is therefore zero.

Now, when the measured value X increases, the value $Y_1$ follows with a delay in time. The difference $Y=X-Y_1$ becomes unequal to zero.

The faster X varies, the higher becomes the value Y. Small variations or changes of X result in small values of Y only. The same applies to slow variations. The slower the variation of X, the smaller will be the value of Y. Accordingly, the magnitude of output signal Y depends on the value and the rate of change of X.

The weighting of the rate of change is performed by the setting of the time constant $T_1$ of the delay element.

If $T_1$ is set too high, the system responds to every change of the input signal X regardless of how slow it is. The smaller $T_1$ is chosen, the lesser becomes the effect of slow changes.

Stated another way, given a time constant $T_1$, the changes which take place very much slower than $T_1$ do not have any effect on the signal Y. Changes which occur much faster than $T_1$, however, have an effect on the signal Y to the full magnitude of the input signal variation.

If a dead time or difference time element 3 is used instead of a first order delay element 2, the dead time $T_2$ constitutes the determining variable. In this case, the output signal Y has the value or magnitude by which the input signal X has varied in the period $T_2$. The smaller $T_2$ is chosen, the smaller becomes the effect of slow changes of the input signal X on the output signal Y.

The signal Y is applied to a threshold or limit stage 4. The threshold stage 4 produces an output Z when a prescribed first threshold value is exceeded. By varying this threshold value, it is possible to control the amplitude weighting of the input signal change or variation. The higher the threshold value is set, the greater must be the input value change to cause the threshold stage 4 to respond.

The advantage of this system, as compared to the classical differentiation dX/dt, is that the amount or magnitude of the change of the signal X also has an effect, in addition to the rate of change. Small changes, as fast as they may take place, do not have any effect on the output of the threshold stage 4, as long as the amount or magnitude of the change is below the switching threshold of the threshold stage 4. Accordingly, this circuit, in a most simple manner, is rendered insensitive to measuring noise.

In contrast, the output signal of a classical differentiation circuit dX/dt is always proportional to the rate of change, irrespective of the magnitude of change.

Figure 3:
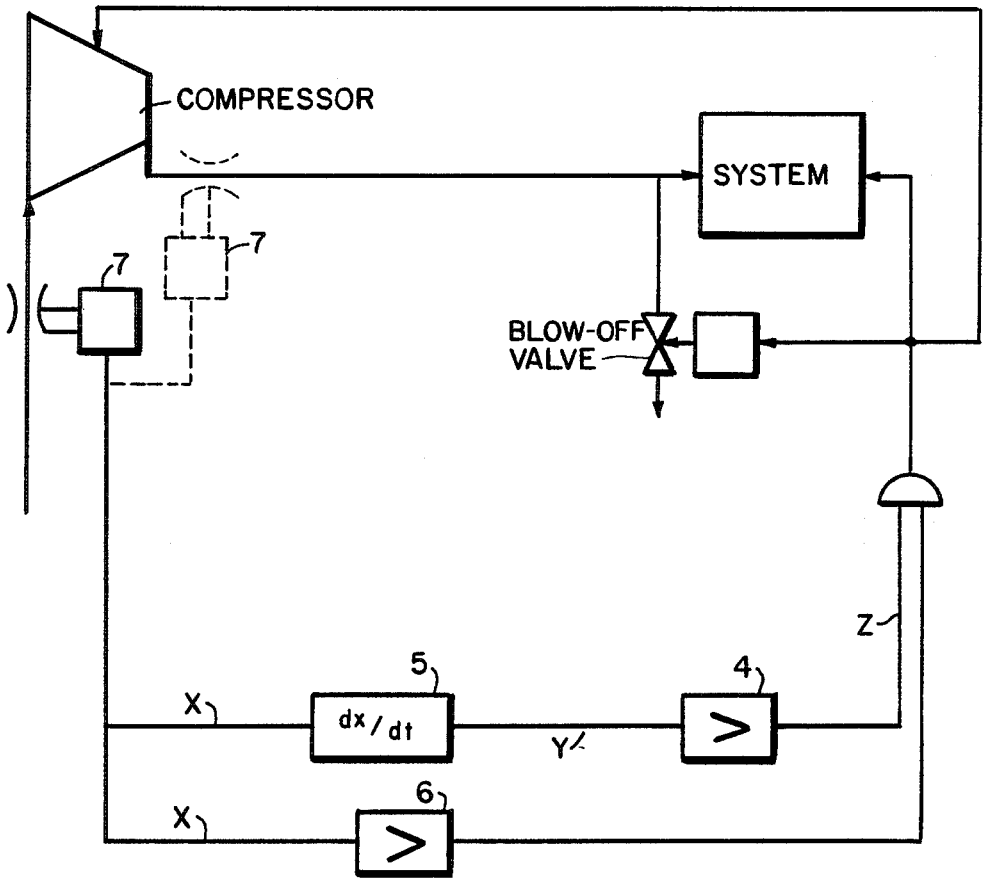
FIG. 3 is a block diagram of a system according to the present invention having a differentiator.

In the alternative, the signal X can be passed through a classical differentiation circuit 5 as shown in FIG. 3. In this case, it would be desirable to provide a separate, additional threshold stage 6 which produces an output indicative of surge when the signal X exceeds a prescribed second threshold value.

When the threshold stage 4 or threshold stage 6 responds, thereby to detect the presence of a surge, the customary safety measures for protection of the compressor or the entire system may be taken. These measures may comprise, for example, immediate opening of a blow-off valve effecting other variations in the compressed gas system or in the operation of the compressor, as indicated in FIG. 1.

There has thus been shown and described a novel system for detecting surges in a turbo-compressor which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the claims which follow.

What is claimed is:

1. A method for detecting pressure surges in a turbo-compressor having intake and outlet ports, said method comprising the steps of:

(a) measuring one of the gas flow rate or gas velocity at one of said intake or outlet ports of said compressor, the measured quantity being represented by a signal X;

(b) determining the rate of change of said signal X, said rate of change being represented by a signal Y; and (c) determining when said signal Y exceeds a prescribed first threshold value;

whereby the occurrence of surge is indicated when said signal Y exceeds said first threshold value.

2. The method defined in claim 1, wherein said one of said gas flow rate or said gas velocity is measured by means of a differential pressure transducer.

3. The method defined in claim 1, wherein said rate of change of said signal X is determined by a differentiator, the output of said differentiator being represented by said signal Y.

4. The method defined in claim 1, further comprising the step of determining when said signal X exceeds a prescribed second threshold value, thereby indicating the occurrence of surge when both threshold values are exceeded.

5. The method defined in claim 1, wherein said step of determining said rate of change of said signal X includes the steps of delaying said signal X to produce a signal $Y_1$, and determining the difference between said signal X and said signal $Y_1$, said difference being represented by said signal Y.

6. The method defined in claim 5, wherein said delaying step includes the step of delaying said said signal X by a first order delay time.

7. The method defined in claim 5, wherein said delaying step includes the step of delaying said signal X by a prescribed period of time.

8. The method defined in claim 1, further comprising the step of immediately opening a blow-off valve at the outlet of said compressor when said signal Y exceeds said first threshold value.

9. The method defined in claim 1, further comprising the step of changing the conditions of operation of said compressor when said signal Y exceeds said first threshold value.

10. The apparatus defined in claim 1, further comprising means for changing the conditions of operation of the compressor upon occurrence of said output signal Z.

11. Open loop control apparatus for detecting pressure surges in a turbo-compressor having intake and outlet ports, said apparatus comprising, in combination:

(a) means for measuring one of the gas flow rate or gas velocity at one of said intake or outlet ports of said compressor and producing a signal X representing the measured quantity;

(b) means, connected to said measuring means, for determining the rate of change of said signal X and producing a signal Y representing said rate of change; and (c) means, connected to said rate of change determining means, for determining when said signal Y exceeds a prescribed threshold value and producing an output signal Z when said threshold value is exceeded;

whereby the occurrence of surge is indicated by the presence of said output signal.

12. The apparatus defined in claim 11, wherein said measuring means is a differential pressure transducer.

13. The apparatus defined in claim 11, wherein said rate of change determining means is a differentiator.

14. The apparatus defined in claim 11, further comprising means for determining when said signal X exceeds a prescribed second threshold value and producing an output signal indicating the occurrence of surge when both threshold values are exceeded.

15. The apparatus defined in claim 11, wherein said rate of change determining means includes means for delaying said signal X to produce a delayed signal $Y_1$, and means for determining the difference between said signal X and said signal $Y_1$ and producing and output signal Y representative of said difference.

16. The apparatus defined in claim 15, wherein said delaying means includes means for delaying said signal X by a first order delay time.

17. The apparatus defined in claim 15, wherein said delaying means includes means for delaying said signal X by prescribed period of time.

18. The apparatus defined in claim 11, further comprising a blow-off valve, connected to the outlet port of said compressor, and means for immediately opening said blow-off valve upon occurrence of said output signal Z.

* * * * *